US007823873B1

(12) United States Patent
Su

(10) Patent No.: US 7,823,873 B1
(45) Date of Patent: Nov. 2, 2010

(54) PAPER FEEDING DEVICE FOR SHREDDER

(76) Inventor: Chao-Lung Su, 1F, No. 16, Lane 173, Sec. 1, Jhongcheng Rd., Taipei (TW)

( * ) Notice: Subject to any disclaimer, the term of this patent is extended or adjusted under 35 U.S.C. 154(b) by 9 days.

(21) Appl. No.: 12/456,105

(22) Filed: Jun. 11, 2009

(51) Int. Cl.
*B65H 1/02* (2006.01)
*B02C 23/02* (2006.01)

(52) U.S. Cl. ..... 271/149; 241/225

(58) Field of Classification Search ..... 271/147, 271/148, 149, 152, 154, 155, 160; 241/225
See application file for complete search history.

(56) References Cited

U.S. PATENT DOCUMENTS 4,765,605 A * 8/1988 Abbott ..... 271/147
6,149,147 A * 11/2000 Hur et al. ..... 271/160
6,227,533 B1 * 5/2001 Jang ..... 271/109
7,490,789 B2 * 2/2009 Omi ..... 241/225

FOREIGN PATENT DOCUMENTS

JP 04251035 A * 9/1992

* cited by examiner

*Primary Examiner*—Kaitlin S Joerger
(74) *Attorney, Agent, or Firm*—William E. Pelton, Esq.; Cooper & Dunham LLP

(57) ABSTRACT

A paper feeding device is mounted in a shredder and has a casing, and a pushing assembly and a feeding assembly mounted in the casing. When a stack of paper is put into the paper feeding device, the pushing assembly pushes the paper forward and the feeding assembly automatically feeds some of the paper into the shredder to shred the paper into small pieces until shredding of the stack of paper is complete. Furthermore, according to a capability of a cutting mechanism of the shredder, the feeding assembly is adjustable to feed different quantities of paper at a time. Therefore, the paper feeding device for the shredder is convenient, time saving and efficient.

9 Claims, 7 Drawing Sheets

PAPER FEEDING DEVICE FOR SHREDDER

BACKGROUND OF THE INVENTION

1. Field of the Invention

The present invention relates to a paper feeding device, especially to a paper feeding device for a shredder having adjustable sheet quantity for faster shredding.

2. Description of the Prior Art(s)

A shredder shreds documents or files into small pieces to render information thereon unreadable. To shred a stack of paper with a conventional shredder, the paper must be manually fed in small piles, which is troublesome and wastes time.

Therefore, another conventional shredder has been developed having a paper feeding device. The paper feeding device may be a roller or a paging mechanism. The paper feeding device separates the stack of paper and feeds the paper into the conventional shredder. Although a cutting mechanism of the shredder can simultaneously shred more than one sheet of paper at a time, the paper feeding device still feeds one sheet of paper to the shredder at a time, thereby limiting a quantity of paper that can be shredded per time period.

To overcome the shortcomings, the present invention provides a paper feeding device for a shredder to mitigate or obviate the aforementioned problems.

SUMMARY OF THE INVENTION

The main objective of the present invention is to provide a paper feeding device for a shredder. The paper feeding device is mounted in the shredder and has a casing, and a pushing assembly and a feeding assembly mounted in the casing.

When a stack of paper is put into the paper feeding device, the pushing assembly pushes the paper forward and the feeding assembly automatically feeds some of the paper into the shredder to shred the paper into small pieces until shredding of the stack of paper is complete.

Furthermore, according to a capability of a cutting mechanism of the shredder, the feeding assembly is adjustable to feed different quantity of paper at a time. Therefore, the paper feeding device for the shredder is convenient, time saving and efficient.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
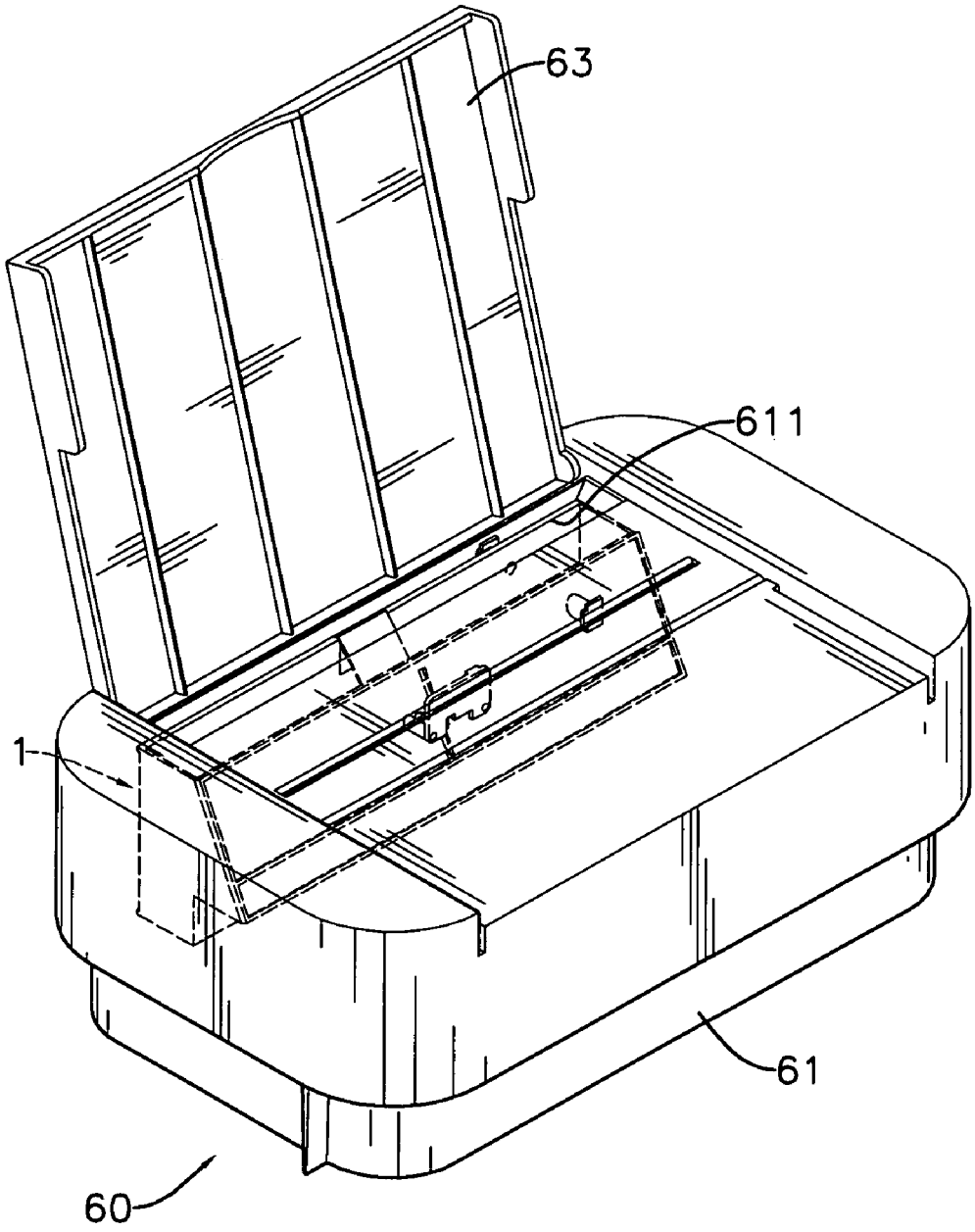
FIG. 1 is a perspective view of a shredder with a paper feeding device in accordance with the present invention.
Figure 2:
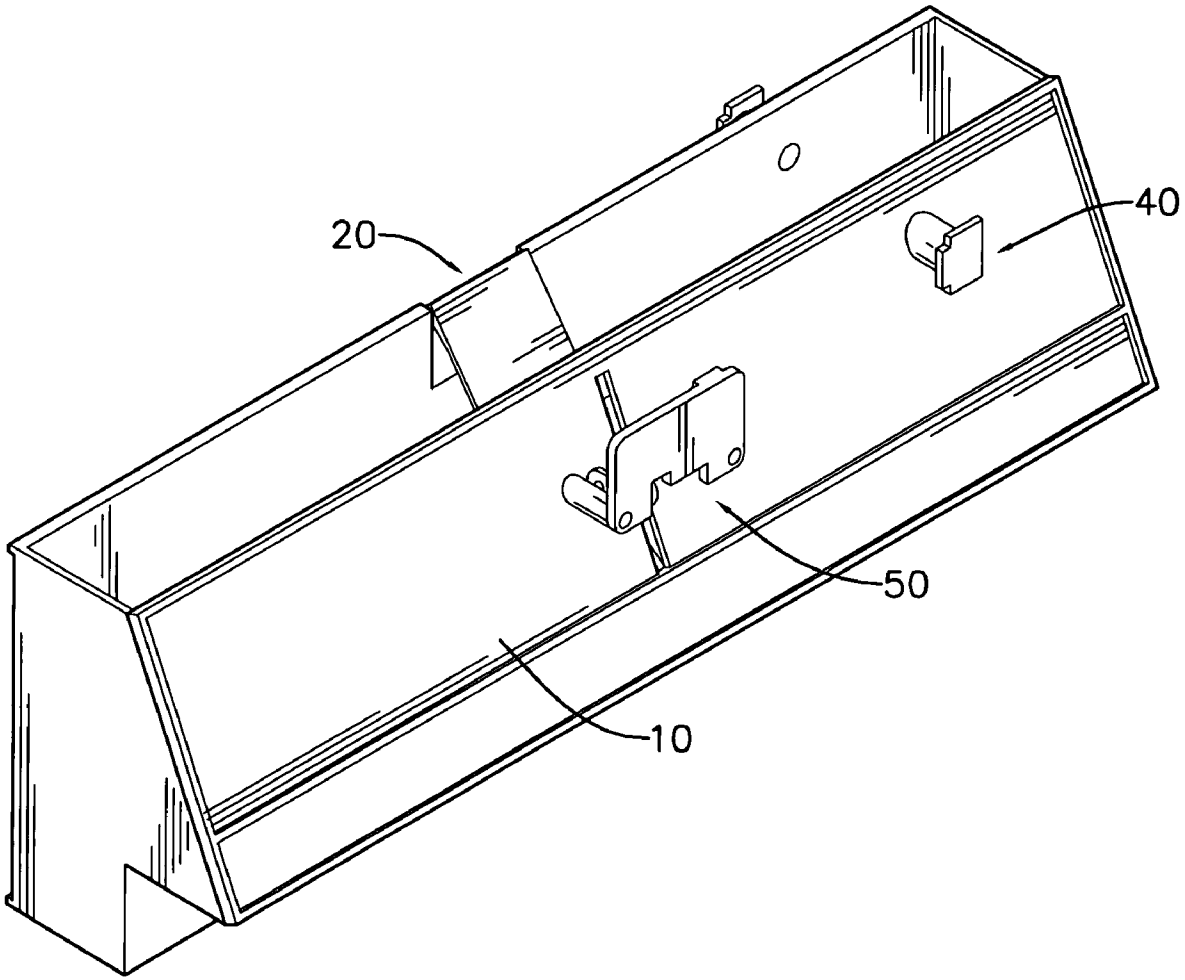
FIG. 2 is a perspective view of the paper feeding device in FIG. 1.
Figure 3:
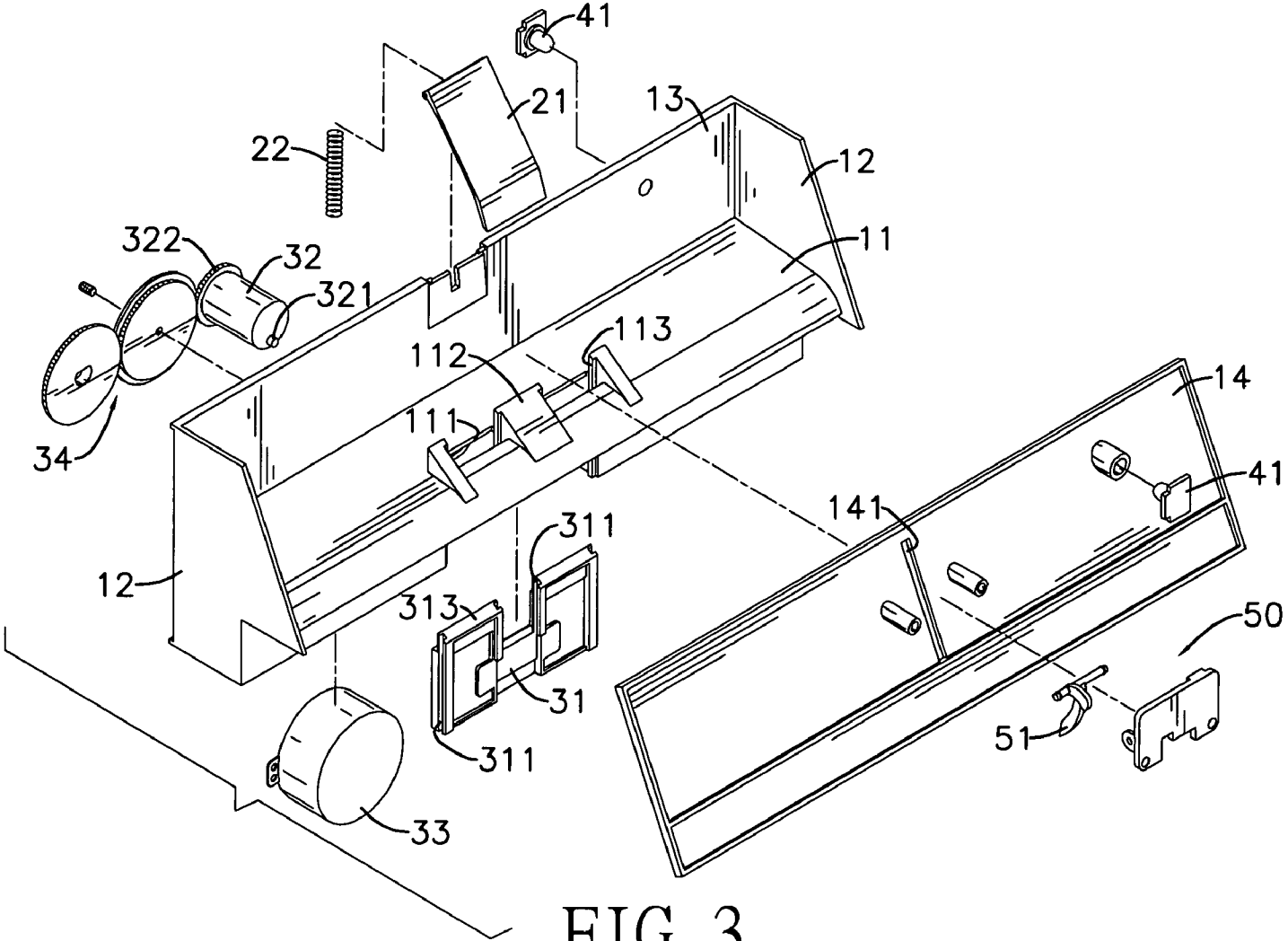
FIG. 3 is an exploded perspective view of the paper feeding device in FIG. 1.
Figure 4:
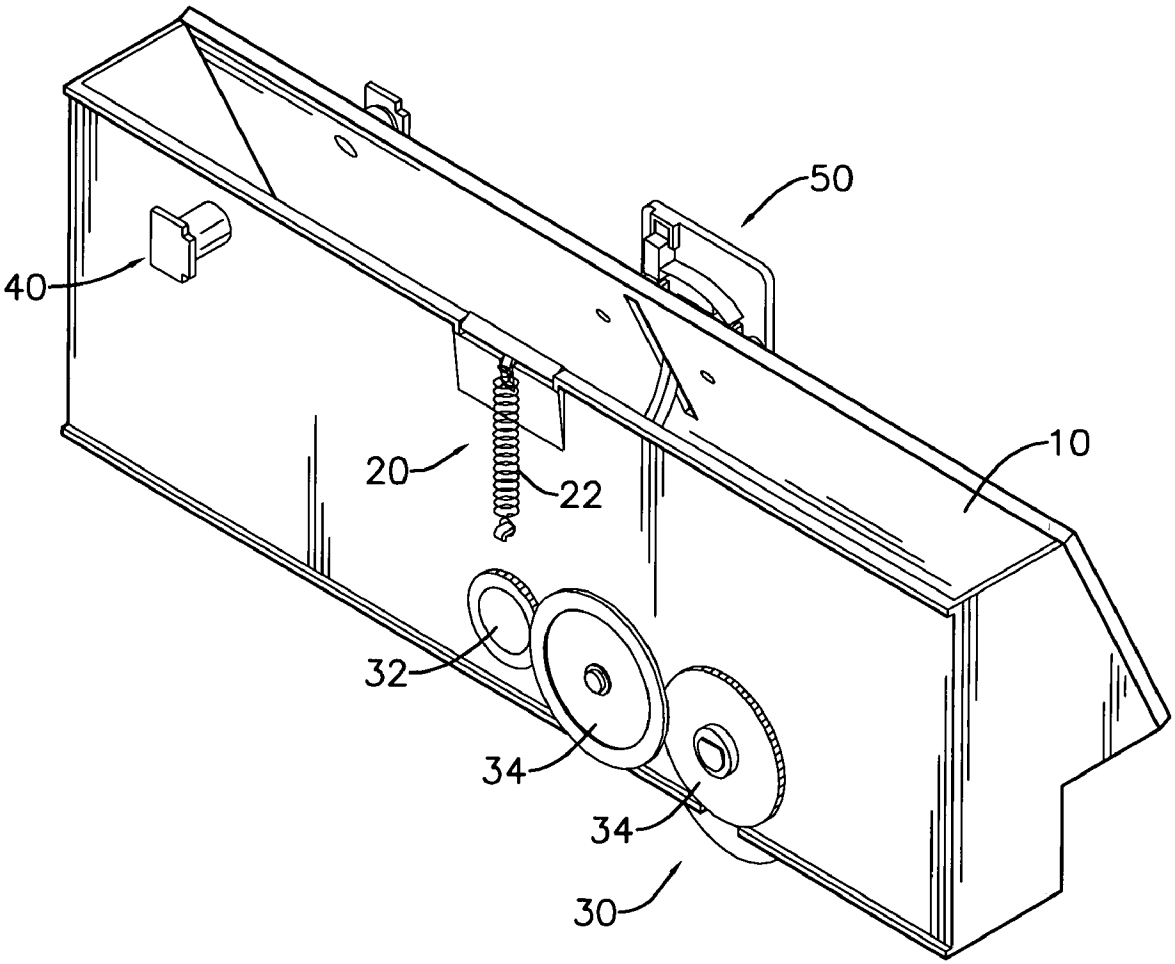
FIG. 4 is another perspective view of the paper feeding device in FIG. 1.
Figure 5:
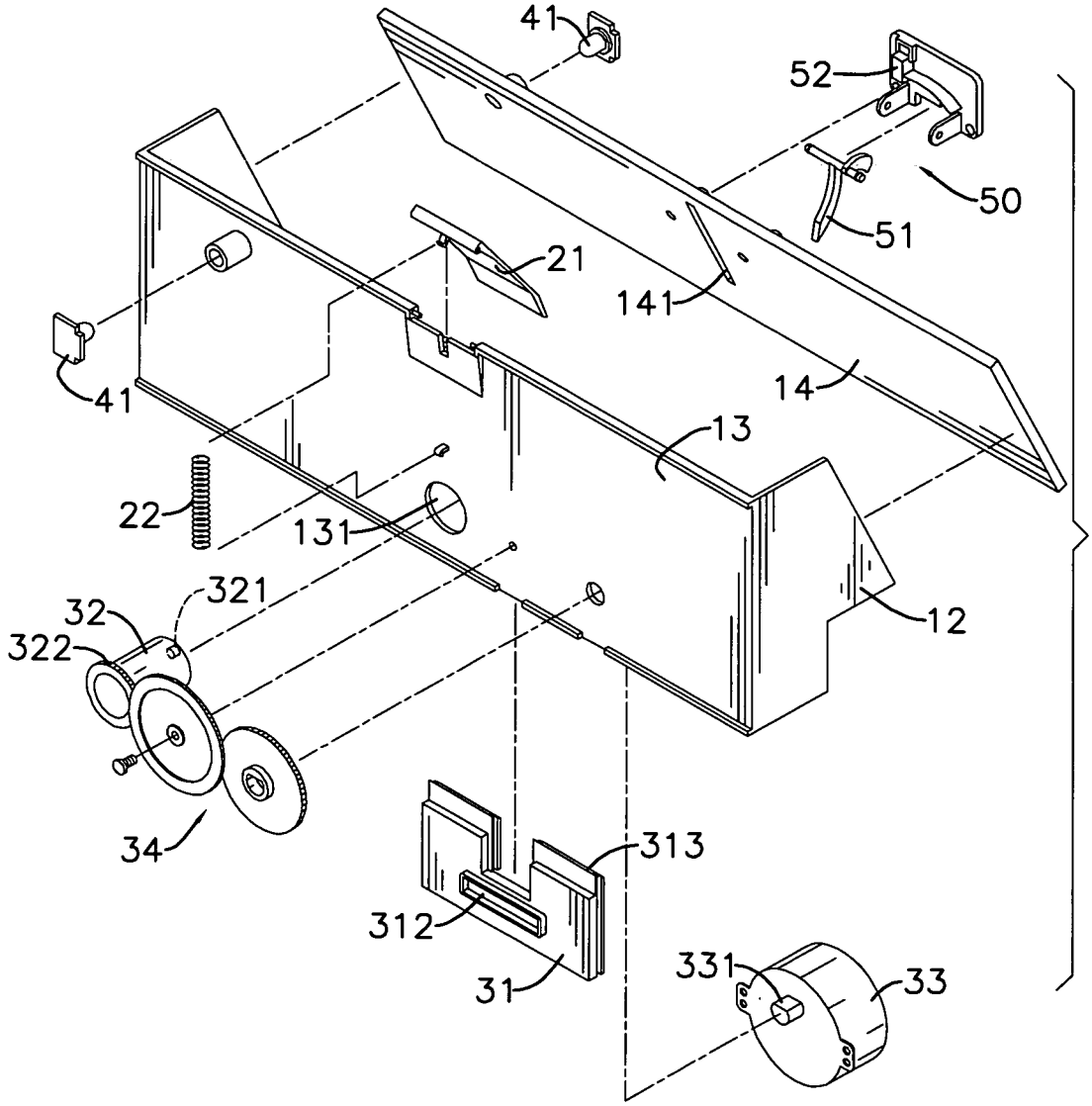
FIG. 5 is another exploded perspective view of the paper feeding device in FIG. 1.
Figure 6:
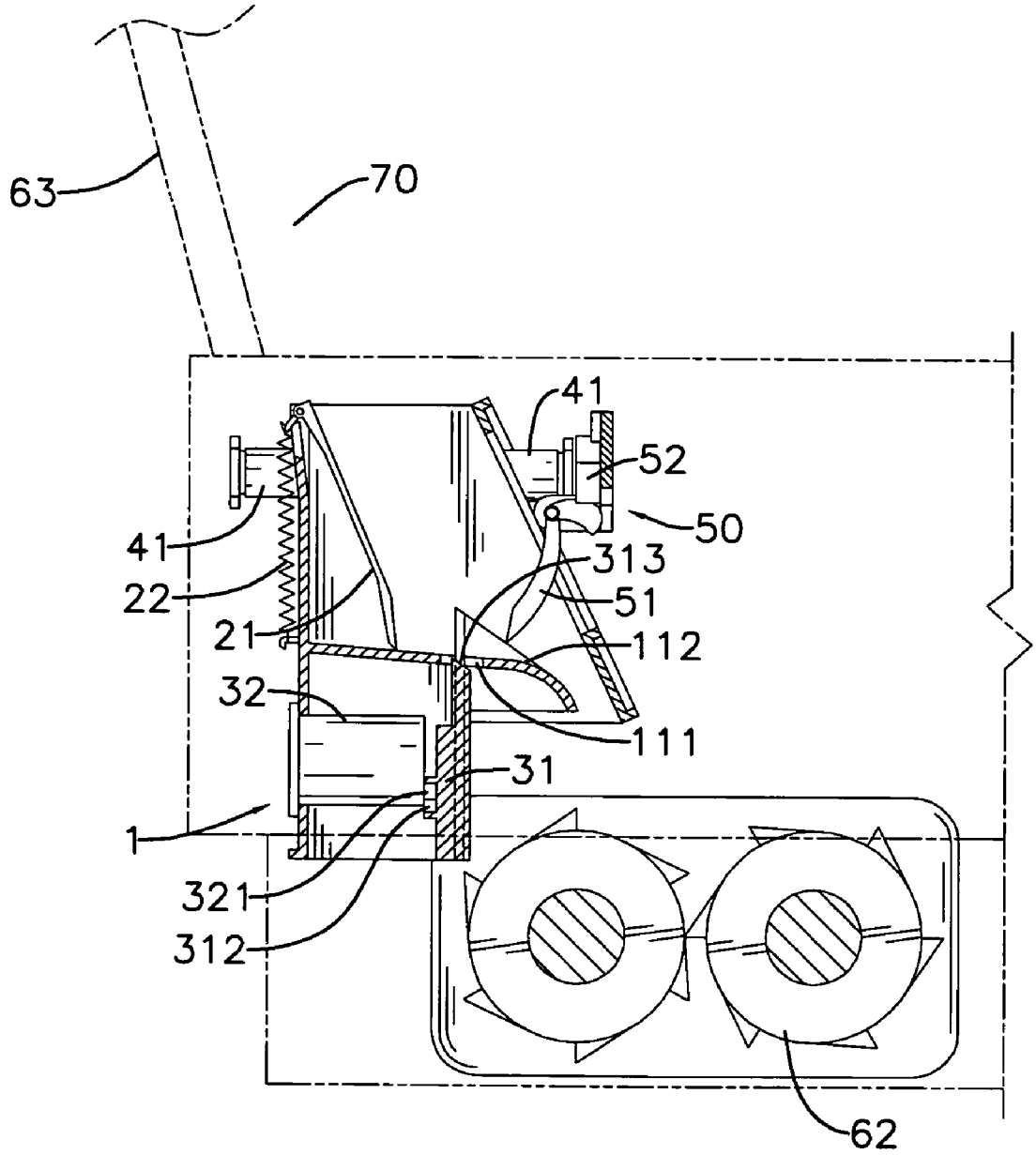
FIG. 6 is an operational schematic side view in partial section of the paper feeding device in FIG. 1.

With reference to FIGS. 1 and 6, a shredder (60) is connected to a rubbish container and comprises a housing (61), multiple cutting rollers (62) and a slide (63). The housing (61) has a front, a rear, a top, a bottom, an entrance (611) and an exit. The entrance (611) is formed through the top adjacent to the rear of the housing (61). The exit is formed through the bottom adjacent to the front of the housing (61) and communicates with the rubbish container. The cutting rollers (62) are parallelly mounted rotatably in the housing (61) and correspond to the exit of the housing (61). The slide (63) is mounted obliquely on the top adjacent to the entrance (611) of the housing (61).

With further reference to FIGS. 2 to 5, a paper feeding device (1) for a shredder (60) in accordance with the present invention is mounted in the housing (61), comprises a casing (10), a pushing assembly (20) and a feeding assembly (30) and may comprise a feeding controller (40) and a cutting controller (50).

The casing (10) is mounted securely in the housing (61), corresponds to the entrance (611) of the housing (61) and has a supporting panel (11), two side panels (12), a rear panel (13) and a front panel (14).

The supporting panel (11) has an upper surface, two opposite side edges, a rear edge, a front edge, a through hole (111) and at least one guider (112) and may have multiple tracks (113). The through hole (111) is formed through the supporting panel (11). The at least one guider (112) is formed on the upper surface adjacent to the through hole (111) of the supporting panel (11) and may be triangular in cross-section. The tracks (113) are formed on the at least one guider (112) and are perpendicular to the supporting panel (11).

The side panels (12) are attached respectively to the side edges of the supporting panel (11).

The rear panel (13) is attached to the rear edge of the supporting panel (11) and has a rear surface, an upper edge and a mounting hole (131). The mounting hole (131) is formed through the rear panel (13) and is lower than the supporting panel (11).

The front panel (14) is attached to the side panels (12), is spaced with the front edge of the supporting panel (11) and may have an elongated hole (141). The elongated hole (141) is formed longitudinally through the front panel (14).

The pushing assembly (20) is mounted on the rear panel (13) and has a pushing panel (21) and a spring (22). The pushing panel (21) is obliquely disposed between the supporting panel (11) and the rear panel (13) and has an upper edge and a lower edge. The upper edge of the pushing panel (21) is connected rotatably to the upper edge of the rear panel (13). The lower edge of the pushing panel (21) corresponds to the supporting panel (11). The spring (22) is disposed on the rear surface of the rear panel (13) and has two opposite ends. The ends of the spring (22) are connected respectively to the rear panel (13) and the upper edge of the pushing panel (21).

Figure 7:
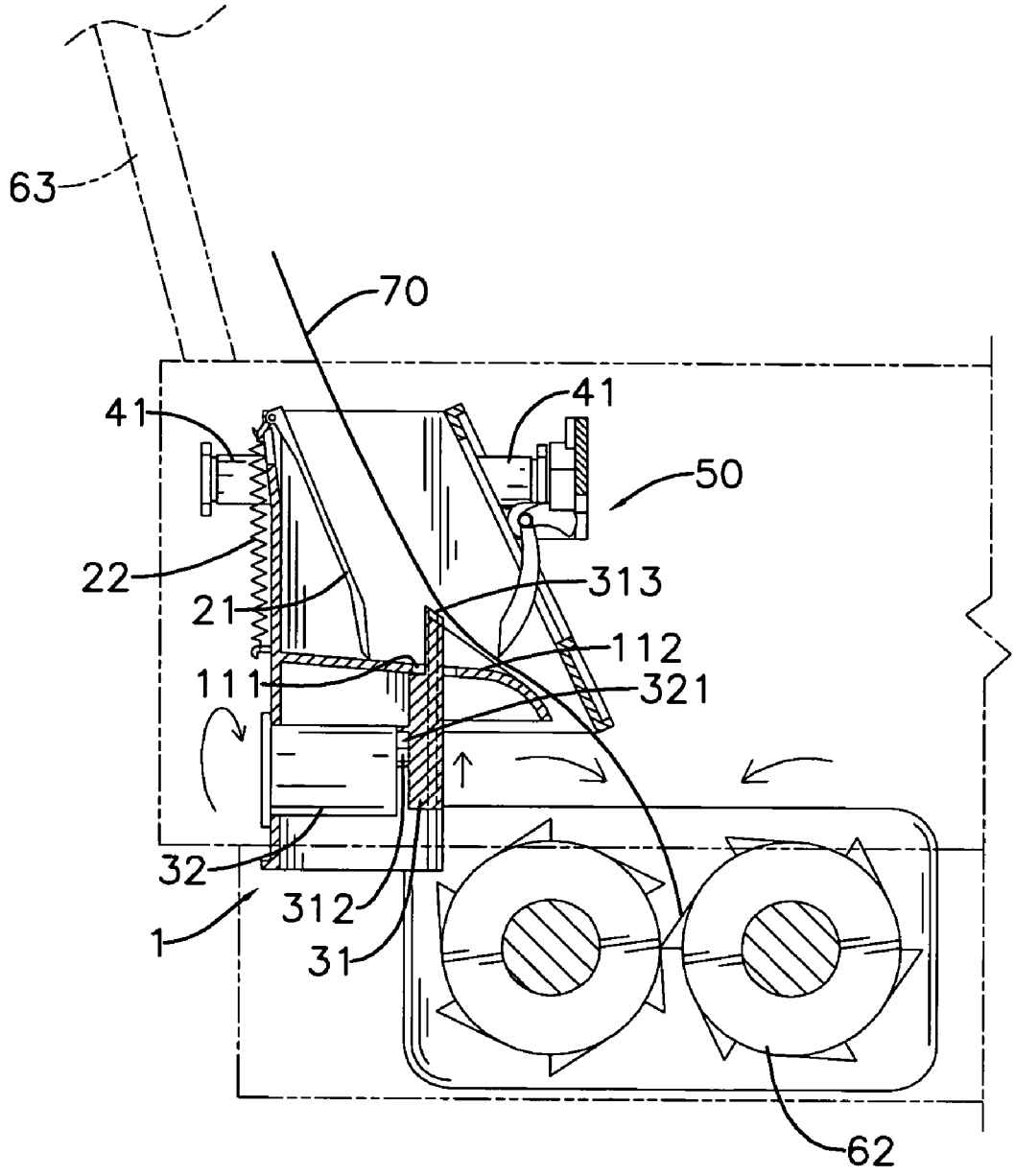
FIG. 7 is another operational schematic side view in partial section of the paper feeding device in FIG. 1.

With further reference to FIG. 7, the feeding assembly (30) is mounted on the casing (10) and has a sliding panel (31), a driver (32) and a motor (33) and may have at least one transmission gear (34).

The sliding panel (31) is mounted slidably through the through hole (111) of the supporting panel (11) and has a rear surface, an upper edge (313), multiple optional grooves (311) and a guiding slot (312). The upper edge (313) of the sliding panel (31) is inclined. The grooves (311) are formed longitudinally in the sliding panel (31) and respectively engage the tracks (113) of the supporting panel (11) to allow the sliding panel (31) to slide in the through hole (111) of the supporting panel (11) along the tracks (113) and the grooves (311). The guiding slot (312) is formed transversely in the rear surface of the sliding panel (31).

The driver (32) is cylindrical, is mounted through the mounting hole (131) of the rear panel (13), has an inner end, an outer end, a side surface and a rotation axis, a protrusion (321) and may have multiple gear teeth (322). The protrusion (321) protrudes eccentrically from the inner end of the driver (32) and into the guiding slot (312) of the sliding panel (31). The gear teeth (322) are formed around the side surface of the driver (32) and adjacent to the outer end of driver (32).

The at least one transmission gear (34) is connected securely to the driving shaft (331) of the motor (33) and engages the gear teeth (322) of the driver (32).

The motor (33) is mounted on the casing (10) and has a driving shaft (331). The driving shaft (331) is connected to and rotates the driver (32) and may be connected to the at least one transmission gear (34) and rotate the driver (32) through the at least one transmission gear (34).

Thus, while a stack of paper (70) is put on the slide (63) of the shredder (60) and slides through the entrance (611) of the housing (61) of the shredder (60) and into the paper feeding device (1), a lower edge of the stack of paper (70) is disposed on the supporting panel (11), corresponds to the through hole (111) of the supporting panel (11) and abuts the guider (112) of the supporting panel (11) of the paper feeding device (1). Some of the paper slides against the through hole (111) and abuts the upper edge (313) of the sliding panel (31). Then, the spring (22) of the pushing assembly (20) pulls and pivots the pushing panel (21) to allow the pushing panel (21) to adjustably push the stack of paper (70) according to a thickness of the stack of paper (70).

As the motor (33) rotates the transmission gear (34) through the driving shaft (331), the driver (32) rotates simultaneously. The protrusion (321) of the driver (32) slides along the guiding slot (312) of the sliding panel (31) to continually lift or lower the sliding panel (31). Therefore, paper (70) abutting the upper edge (313) of the sliding panel (31) are lifted by the sliding panel (31), move along the guider (112) of the supporting panel (11), slide between the front edge of the supporting panel (11) and the front panel (14) and then into the cutting rollers (62) of the shredder (60).

The feeding controller (40) is mounted on the casing (10), is connected electrically to the motor (33) of the feeding assembly (30) and may have multiple sensors (41). The sensors (41) are mounted on the rear panel (13) and the front panel (14) and correspond to each other. When the feeding controller (40) detects that a stack of paper (70) is put into the paper feeding device (1), the feeding controller (40) switches on the motor (33) to drive the driver (32) and the sliding panel (31). When no paper (70) is in the paper feeding device (1), the feeding controller (40) switches off the motor (33) to stop feeding paper (70).

The cutting controller (50) is mounted on the front panel (14), is connected electrically to the cutting rollers (62) and has a swing arm (51) and a switch (52). The swing arm (51) is mounted pivotally on the front panel (14) and through the elongated hole (141) of the front panel (14) and protrudes toward the supporting panel (11). The switch (52) is mounted by the swing arm (51) and is selectively switched by the swing arm (51). The paper (70) slides between the front edge of the supporting panel (11) and the front panel (14) pushes the swing arm (51) to switch on the cutting rollers (62) through the switch (52). Then the paper (70) slides into the cutting rollers (62) are shredded into small pieces.

The paper feeding device (1) for a shredder (60) as described has the following advantages. When shredding the stack of paper (70) with the shredder (60), the stack of paper (70) is placed in the paper feeding device (1) and then the paper feeding device (1) automatically feeds the paper (70) into the shredder (60) without requiring operator intervention. Furthermore, according to a capability of the cutting roller (62), the paper feeding device (1) uses different sliding panels (31) with different size of the upper edge (313) of the sliding panel (31) to feed different quantities of paper (70) at one time. Therefore, the paper feeding device (1) for the shredder (60) is convenient, time saving and effective.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A paper feeding device comprising:

a casing having
- a supporting panel having
  - an upper surface;
  - two opposite side edges;
  - a rear edge;
  - a front edge;
  - a through hole formed through the supporting panel; and
  - at least one guider formed on the upper surface adjacent to the through hole of the supporting panel;
- two side panels attached respectively to the side edges of the supporting panel;
- a rear panel attached to the rear edge of the supporting panel and having
  - a rear surface;
  - an upper edge; and
  - a mounting hole formed through the rear panel and being lower than the supporting panel; and
- a front panel attached to the side panels and spaced with the front edge of the supporting panel;

a pushing assembly mounted on the rear panel and having
- a pushing panel obliquely disposed between the supporting panel and the rear panel and having
  - an upper edge connected rotatably to the upper edge of the rear panel; and
  - a lower edge corresponding to the supporting panel; and
- a spring disposed on the rear surface of the rear panel and having two opposite ends connected respectively to the rear panel and the upper edge of the pushing panel; and a feeding assembly mounted on the casing and having
- a sliding panel mounted slidably through the through hole of the supporting panel and having
  - a rear surface;
  - an upper edge being inclined; and
  - a guiding slot formed transversely in the rear surface of the sliding panel;
- a driver being cylindrical, mounted through the mounting hole of the rear panel and having
  - an inner end;
  - an outer end;

a side surface;

a rotation axis;

a protrusion protruding from the inner end of the driver and into the guiding slot of the sliding panel and misaligning with the rotation axis of the driver; and a motor mounted on the casing and having a driving shaft connected to and rotating the driver.

2. The paper feeding device as claimed in claim 1 further comprising a feeding controller mounted on the casing and connected electrically to the motor of the feeding assembly.

3. The paper feeding device as claimed in claim 2, wherein the feeding controller further has multiple sensors mounted on the rear panel and the front panel and correspond to each other.

4. The paper feeding device as claimed in claim 1, wherein the front panel of the casing further has an elongated hole formed longitudinally through the front panel; and the paper feeding device further comprises a cutting controller mounted on the front panel and having a swing arm mounted pivotally on the front panel and through the elongated hole of the front panel and protruding toward the supporting panel; and a switch mounted by the swing arm and selectively switched by the swing arm.

5. The paper feeding device as claimed in claim 2, wherein the front panel of the casing further has an elongated hole formed longitudinally through the front panel; and the paper feeding device further comprises a cutting controller mounted on the front panel and having a swing arm mounted pivotally on the front panel and through the elongated hole of the front panel and protruding toward the supporting panel; and a switch mounted by the swing arm and selectively switched by the swing arm.

6. The paper feeding device as claimed in claim 3, wherein the front panel of the casing further has an elongated hole formed longitudinally through the front panel; and the paper feeding device further comprises a cutting controller mounted on the front panel and having a swing arm mounted pivotally on the front panel and through the elongated hole of the front panel and protruding toward the supporting panel; and a switch mounted by the swing arm and selectively switched by the swing arm.

7. The paper feeding device as claimed in claim 6, wherein the supporting panel of the casing further has multiple tracks formed on the at least one guider and being perpendicular to the supporting panel; and the sliding panel of the feeding assembly further has multiple optional grooves formed longitudinally in the sliding panel and respectively engaging the tracks of the supporting panel.

8. The paper feeding device as claimed in claim 7, wherein the driver of the feeding assembly further has multiple gear teeth formed around the side surface of the driver and adjacent to the outer end of driver;

the feeding assembly further has at least one transmission gear connected securely to the driving shaft of the motor and engaging the gear teeth of the driver; and the driving shaft of the motor of the feeding assembly connected to the at least one transmission gear and rotating the driver through the at least one transmission gear.

9. The paper feeding device as claimed in claim 8, wherein the at least one guider of supporting panel of the casing is triangular in cross-section.

* * * * *